US007871476B2

(12) United States Patent
Mukai et al.

(10) Patent No.: US 7,871,476 B2
(45) Date of Patent: Jan. 18, 2011

(54) MAGNESIUM ALLOY EXHIBITING HIGH STRENGTH AND HIGH DUCTILITY AND METHOD FOR PRODUCTION THEREOF

(75) Inventors: Toshiji Mukai, Ibaraki (JP); Kazuhiro Hono, Ibaraki (JP); Hidetoshi Somekawa, Ibaraki (JP); Tomoyuki Honma, Ibaraki (JP)

(73) Assignee: National Institute for Materials Science, Ibaraki (JP)

( * ) Notice: Subject to any disclaimer, the term of this patent is extended or adjusted under 35 U.S.C. 154(b) by 855 days.

(21) Appl. No.: 11/631,373

(22) PCT Filed: Jun. 28, 2005

(86) PCT No.: PCT/JP2005/012279

§ 371 (c)(1),
(2), (4) Date: Jun. 13, 2007

(87) PCT Pub. No.: WO2006/004072

PCT Pub. Date: Jan. 12, 2006

(65) Prior Publication Data

US 2008/0017285 A1 Jan. 24, 2008

(30) Foreign Application Priority Data

Jun. 30, 2004 (JP) ..... 2004-194912

(51) Int. Cl.
*C22C 23/00* (2006.01)

(52) U.S. Cl. ..... 148/420; 148/667

(58) Field of Classification Search ..... 148/420, 148/667

See application file for complete search history.

(56) References Cited

U.S. PATENT DOCUMENTS 5,693,158 A 12/1997 Yamamoto et al.

FOREIGN PATENT DOCUMENTS

| | | | |
|---|---|---|---|
| JP | 7-188826 | | 7/1995 |
| JP | 09041065 A | * | 2/1997 |
| JP | 9-263871 | | 10/1997 |
| JP | 2002-371334 | | 12/2002 |
| JP | 2003-155547 | | 5/2003 |

* cited by examiner

*Primary Examiner*—George Wyszomierski
*Assistant Examiner*—Weiping Zhu
(74) *Attorney, Agent, or Firm*—Wenderoth, Lind & Ponack, L.L.P.

(57) ABSTRACT

A magnesium alloy exhibiting high strength and high ductility, characterized in that it comprises 0.03 to 0.54 atomic % of certain solute atoms belonging to 2 Group, 3 Group or Lanthanoids of the Periodic Table and having an atomic radius larger than that of magnesium and the balanced amount of magnesium, and has a fine crystal grain structure wherein solute atoms having an average crystal grain diameter of 1.5 μm or less and being unevenly present in the vicinity of crystal grain boundaries at a concentration being 1.5 to 10 times that within crystal grains, wherein an atom selected from the group consisting of Ca, Sr, Ba, Sc, Y, La, Ce, Pr, Nd, Pm, Sm, Eu, Gd, Th, Dy, Ho, Er, Tm, Yb and Lu can be used as the above solute atom; and a method for producing the magnesium alloy. The above magnesium alloy is novel and achieves high strength and high ductility at the same time.

6 Claims, 4 Drawing Sheets

(a)

(b)

(a)

(b)

(a)

(b)

MAGNESIUM ALLOY EXHIBITING HIGH STRENGTH AND HIGH DUCTILITY AND METHOD FOR PRODUCTION THEREOF

TECHNICAL FIELD

The present invention relates to a high strength and high ductility magnesium alloy and a method for production thereof.

BACKGROUND ART

Heretofore, as a material for power-driven structures such as automobiles, magnesium alloys which are light in weigh have been widely used. To use a magnesium alloy for such structures, its structure-sustaining reliability and safety have to be guaranteed, and for that purpose, high strength magnesium alloys have been proposed.

For example, Patent Document 1 discloses a high strength magnesium alloy comprising (a) 4 to 15% by mass of Gd or Dy, and (b) 0.8 to 5% by mass of at least one element selected from the group consisting of Ca, Y and Lanthanoids [provided that the component (a) is excluded], and further, if desired, 2% by mass or less of at least one element selected from the group consisting of Zr and Mn, and the balanced amount of Mg. This high strength magnesium alloy is produced by subjecting materials of the above composition for forging to homogenizing treatment at 430 to 570° C. for 2 to 7 hours, warm forging the materials for forging at a temperature of the materials for forging of 380 to 570° C. and at a mold temperature of 250 to 400° C. which is lower than the temperature of the materials for forging, and age-hardening the obtained warm forged product at 180 to 290° C. for 2 to 400 hours.

Further, Patent Document 2 discloses a high strength magnesium alloy wherein the average composition of the entire alloy is represented by the compositional formula $Mg_{100-a-b}Ln_aZn_b$ (wherein Ln is at least one rare earth element selected from Y, La, Ce, Pr, Nd, Pm, Sm, Eu, Gd, Tb, Dy, Ho, Er, Tm, Yb, Lu and a misch metal, $0.5 \leqq a \leqq 5$, $0.2 \leqq b \leqq 0.4$ and $1.5 \leqq a+b \leqq 7$), and the average crystal grain diameter of the mother phase is 5 μm or less. In this high strength magnesium alloy, in part of crystal grains of the mother phase, a concentration modulation such that the concentration is changed in the crystal grains without precipitation of a new compound is present, and the total concentration of the rare earth element (Ln) is increased by 1 to 6 atomic % and/or the concentration of Zn is increased by 1 to 6 atomic % as compared with the average composition of the entire alloy. This high strength magnesium alloy is produced by rapidly solidifying a molten magnesium alloy having the above composition at a cooling rate of 100 K/s or higher, preparing a powdery alloy having an average grain diameter of about 30 μm by means of a grinder such as a rotor mill, filling an extrusion container with the powdery alloy, and carrying out extrusion with an extrusion ratio (by sectional area ratio) of 3 to 20 with heating. Further, this high strength magnesium alloy has a tensile elongation of 3 to 4%.

Further, Patent Document 3 discloses a high strength magnesium alloy produced by subjecting a magnesium alloy such as a Mg—Zn—Zr system, e.g. ZK60, a Mg—Al—Zn system, e.g. AZ61, or a Mg—Mn system to liquidizing treatment, applying a pre-strain of at least 0.4 in a temperature region of 250 to 400° C. in a first forging step, then carrying out aging, and then carrying out second forging at a predetermined temperature not higher than the temperature at the above forging step, so that the alloy has a fine crystal grain structure with an average crystal grain diameter of 10 μm or less.

According to the invention disclosed in the publication, the component segregation is eliminated by carrying out liquidizing treatment so that the magnesium compound which has been unevenly precipitated in the material is sufficiently solid-solubilized in the structure. Then, a predetermined pre-strain is applied to the material in the forging step, and in the subsequent aging treatment, spherical fine grains of the magnesium compound having a small aspect ratio are precipitated, to uniformalize the structure. Then, by the precipitated fine grains, in the forging step, the crystal grain growth in the super-heating procedure to a temperature at which the material is forged is inhibited, whereby stable fine crystal grain structure is formed by the crystal grain refinement effect by the forging.

Whereas, Non-Patent Document 1 discloses a Mg-0.9% by mass Ca (corresponding to 0.55 atomic %) cast material, and the effect of addition of a small amount of Ca to Mg is discussed. To this magnesium alloy, not any other heat treatment is applied. This magnesium alloy has a yield strength at room temperature of about 100 MPa and a tensile elongation of several %. The strengthening mechanism is by precipitation strengthening due to the lamellar phase of $Mg_2Ca$, but the ductility is very low due to the presence of precipitates having a high volume fraction.

Further, Non-Patent Document 2 discloses Mg—Y binary cast alloys having Y concentrations of 5 and 8% by mass (corresponding to 1.4 and 2.2 atomic %, respectively), and reports the yield strengths of the cast material and a T6 aging-treated material. The yield strengths of the alloy containing 8% by mass of Y are about 130 MPa and about 240 MPa, respectively as the cast material and the T6 aging-treated material, and the ductility is not disclosed. High strengthening of this alloy is also due to precipitates.

Patent Document 1: Japanese Patent Application Laid-Open No. 9-263871

Patent Document 2: Japanese Patent Application Laid-Open No. 2004-99941

Patent Document 3: Japanese Patent Application Laid-Open No. 2003-277899

Non-Patent Document 1: Materials Transaction Vol. 43, No. 10 (2002), p. 2643 to 2646 (Yasumasa Chino et al.)

Non-Patent Document 2: Materials Transaction Vol. 42, No. 7 (2001), p. 1332 to 1338 (Si-Young Chang et al.)

DISCLOSURE OF INVENTION

The above-described conventionally proposed high strength magnesium alloys have acquired high strength mainly by utilizing crystallization or precipitation of a coarse intermetallic compound by combination of supersaturated different elements, or by uniformly dispersing high concentration precipitates. However, most of the magnesium alloys developed by prior art depend on dispersion strengthening of the intermetallic compound, whereby fracture will easily occur, for example, at the interface of the dispersed compound and as a result, the alloy will be poor in ductility. Particularly when the magnesium alloy is applied to a power-driven structure, it is required to have not only high strength but also high ductility to guarantee structure-sustaining reliability and safety.

Under these circumstances, it is an object of the present invention to provide a novel magnesium alloy which realizes both high strength and high ductility and a method for production thereof.

To achieve the above object, the present invention provides, as a first aspect, a high strength and high ductility magnesium alloy characterized in that it comprises 0.03 to 0.54 atomic % of one type of solute atoms belonging to Group 2, Group 3 or Lanthanoid of the Periodic Table and having an atomic radius larger than that of magnesium, and the balanced amount of magnesium, and has a fine crystal grain structure wherein the average crystal grain diameter is 1.5 μm or less and the solute atoms are localized at portions in the vicinity of the crystal grain boundaries at a concentration of 1.5 to 10 times that of the solute atoms in the crystal grains.

In the present specification, the "concentration" of the solute atoms is the average concentration up to the third neighboring atoms in the vicinity of the crystal grain boundaries measured by means of nano-EDS (energy-disperse X-ray spectroscopy) having an electron beam diameter focused to 0.5 to 1.0 nm.

The present invention further provides, as a second aspect, the above high strength and high ductility magnesium alloy according to the first aspect, wherein the solute atoms are one type of atoms selected from the group consisting of Ca, Sr, Ba, Sc, Y, La, Ce, Pr, Nd, Pm, Sm, Eu, Gd, Th, Dy, Ho, Er, Tm, Yb and Lu.

The present invention further provides a method for producing a high strength and high ductility magnesium alloy comprising 0.03 to 0.54 atomic % of one type of solute atoms belonging to Group 2, Group 3 or Lanthanoid of the Periodic Table and having an atomic radius larger than that of magnesium, and the balanced amount of magnesium, which comprises preparing a mother alloy comprising magnesium and solute atoms, subjecting the obtained mother alloy to homogenizing treatment at a temperature of 450 to 550° C. for 1.5 to 8 hours, followed by quenching, and further applying a warm strain at a temperature of 150 to 350° C. to form a fine crystal grain structure wherein the average crystal grain diameter is 1.5 μm or less and the solute atoms are localized at portions in the vicinity of the crystal grain boundaries at a concentration of 1.5 to 10 times that of the solute atoms in the crystal grains.

The present invention further provides, as a fourth aspect, the above method for producing a high strength and high ductility magnesium alloy according to the above third aspect, which uses, as the solute atoms, one type of atoms selected from the group consisting of Ca, Sr, Ba, Sc, Y, La, Ce, Pr, Nd, Pm, Sm, Eu, Gd, Th, Dy, Ho, Er, Tm, Yb and Lu.

Still further, the present invention provides, as a fifth aspect, the above method for producing a high strength and high ductility magnesium alloy according to the above third or fourth aspect, wherein the warm strain is applied by carrying out warm extrusion with an extrusion ratio (by sectional area ratio) of 16:1 to 100:1.

BEST MODE FOR CARRYING OUT THE INVENTION

The present invention has characteristics as described above, and it will be described in detail below.

The high strength and high ductility magnesium alloy of the present invention is characterized in that it comprises 0.03 to 0.54 atomic % of one type of solute atoms belonging to Group 2, Group 3 or Lanthanoid of the Periodic Table and having an atomic radius larger than that of magnesium, and the balanced amount of magnesium, and has a fine crystal grain structure wherein the average crystal grain diameter is 1.5 μm or less and solute atoms are localized at portions in the vicinity of the crystal grain boundaries at a concentration of 1.5 to 10 times that of the solute atoms in the crystal grains.

The atoms belonging to Group 2 of the Periodic Table and having an atomic radius larger than that of magnesium (atomic radius: 1.60 Å, hereinafter the numerical value in the bracket after the chemical symbol represents the atomic radius) include Ca (1.97 Å), Sr (2.15 Å) and Ba (2.18 Å).

The atoms belonging to Group 3 of the Periodic Table and having an atomic radius larger than that of magnesium include Sc (1.65 Å) and Y (1.82 Å).

The atoms belonging to Lanthanoid of the Periodic Table and having an atomic radius larger than that of magnesium include La (1.88 Å), Ce (1.83 Å), Pr (1.83 Å), Nd (1.82 Å), Pm (1.8 Å), Sm (1.79 Å), Eu (1.99 Å), Gd (1.78 Å), Th (1.76 Å), Dy (1.75 Å), Ho (1.75 Å), Er (1.74 Å), Tm (1.76 Å), Yb (1.94 Å) and Lu (1.73 Å).

According to the present invention, strengthening of the magnesium alloy is realized by (1) refinement of the crystal grain structure and (2) strengthening of the crystal grain boundaries by localization of different atoms having a large difference in the atomic radius at the crystal grain boundaries. Further, high ductility is guaranteed without impairing high strength by (3) maintaining deformability in the grains by suppressing the concentrations of different elements in the crystal grains.

Figure 1:
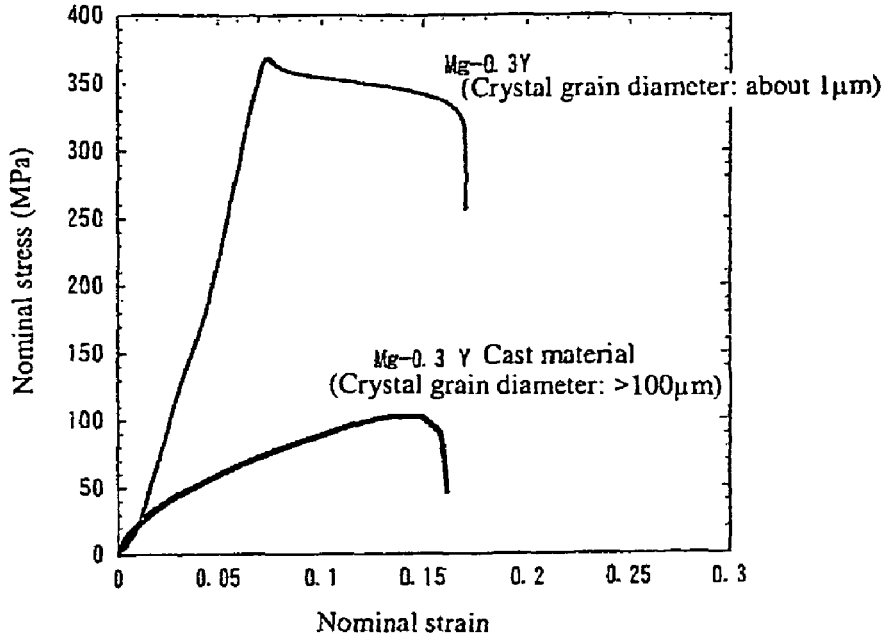
FIGS. 1(*a*) and 1(*b*) are drawings illustrating the results of evaluation of mechanical properties of alloys in Examples by means of a tensile test, and FIG. 1(*a*) represents Mg-0.3Y and FIG. 1(*b*) represents Mg-0.3Ca.
Figure 1:
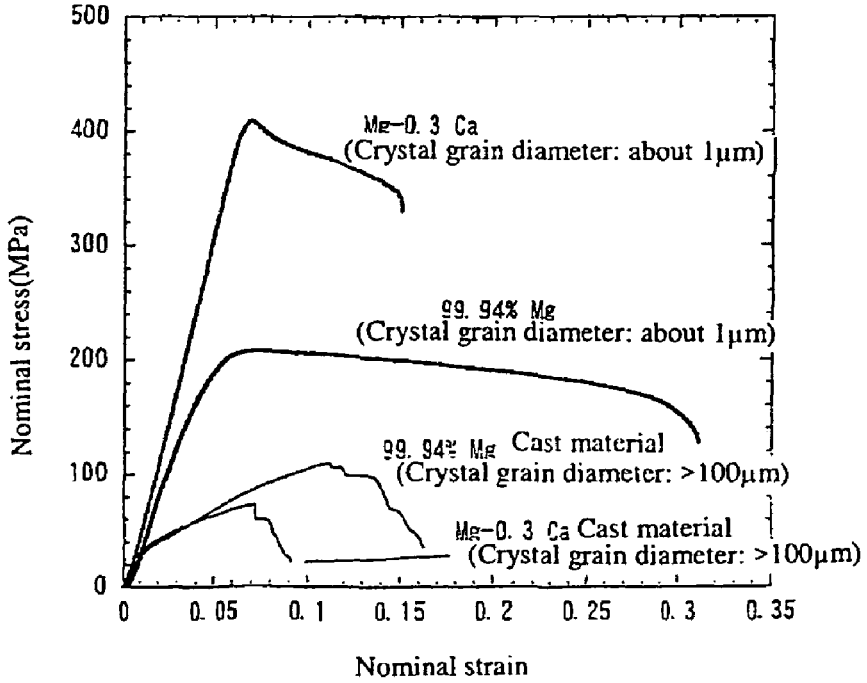

The magnesium alloy of the present invention employs solute atoms having an atomic radius larger than that of magnesium. The larger the atomic radius than that of magnesium as the mother material, the more significant the lattice misfitting due to the difference in the atomic radius, whereby the crystal grain boundaries are likely to be formed in the recrystallization method, and further, the effect of suppressing the slip at the crystal grain boundaries after formation of the fine structure. As a specific example, comparison of the effects of two types of solute atoms shown in FIG. 1 shows that high strengthening by calcium having an atomic radius larger than that of yttrium is more remarkable even at the same concentration of 0.3 atomic %.

Further, the content of the above solute atoms is 0.03 to 0.54 atomic %, more preferably 0.2 to 0.5 atomic %. The content of the solute atoms is limited to this range for the following purposes. That is, the concentration of the metal component to be added to magnesium is made as low as possible and limited to be an amount corresponding to the volume of the crystal grain boundaries, whereby formation of the intermetallic compound is suppressed, and starting points of destruction are reduced as far as possible.

Further, when the content of the solute atoms is within this range, it is possible to cover the portions in the vicinity of the grain boundaries when the solute atoms gather around the vicinity of the crystal grain boundaries in the sub-micron diameter crystal grain structure. Here, in this specification, the "vicinity" of the grain boundaries represents layers of up to the third neighboring atoms. If the content of the solute atoms is too high, formation of the intermetallic compound will not be suppressed, and the ductility will decrease. If the content of the solute atoms is too high, portions in the vicinity of the grain boundaries will not be covered with the solute atoms.

Further, the magnesium alloy of the present invention has a fine crystal grain structure wherein the average crystal grain diameter is 1.5 μm or less, preferably 0.2 to 0.8 μm. If the average crystal grain diameter is larger than 1.5 μm, high strengthening by refinement of the crystal grains may be inhibited.

Increase in the strength by refinement of the crystal grains is evident also from the nominal stress-strain curves obtained with respect to the cast material and the fine crystal grain material at the same concentration as shown in FIG. 1. It is understood that drastic high strengthening is realized without impairing ductility by miniaturization of the crystal grains.

Further, in the fine crystal grain structure of the magnesium alloy of the present invention, the solute atoms are localized at portions in the vicinity of the crystal grain boundaries at a concentration of 1.5 to 10 times, more preferably 2.5 to 10 that of the solute atoms in the crystal grains. If the concentration of the solute atoms at portions in the vicinity of the crystal grain boundaries is lower than the above range, it is not possible to control the structure so that the solute atoms are disposed at a high concentration at portions in the vicinity of the crystal grain boundaries, whereby formation and propagation of cracks at the grain boundaries will not be suppressed. Further, if the concentration of the solute atoms at portions in the vicinity of the crystal grain boundaries is higher than the above range, precipitates will be formed on the grain boundaries, whereby ductility will decrease.

In order that the solute atoms are disposed at a high concentration at portions in the vicinity of the crystal grain boundaries, a means to apply warm strain by, for example, warm extrusion, may be employed. By localization of the solute atoms at a high concentration at portions in the vicinity of the crystal grain boundaries in the fine crystal grain structure so as to construct elaborate strengthening grain boundary network, it is possible to refine the crystal grain structure and to remarkably increase the strength as well.

Figure 2:
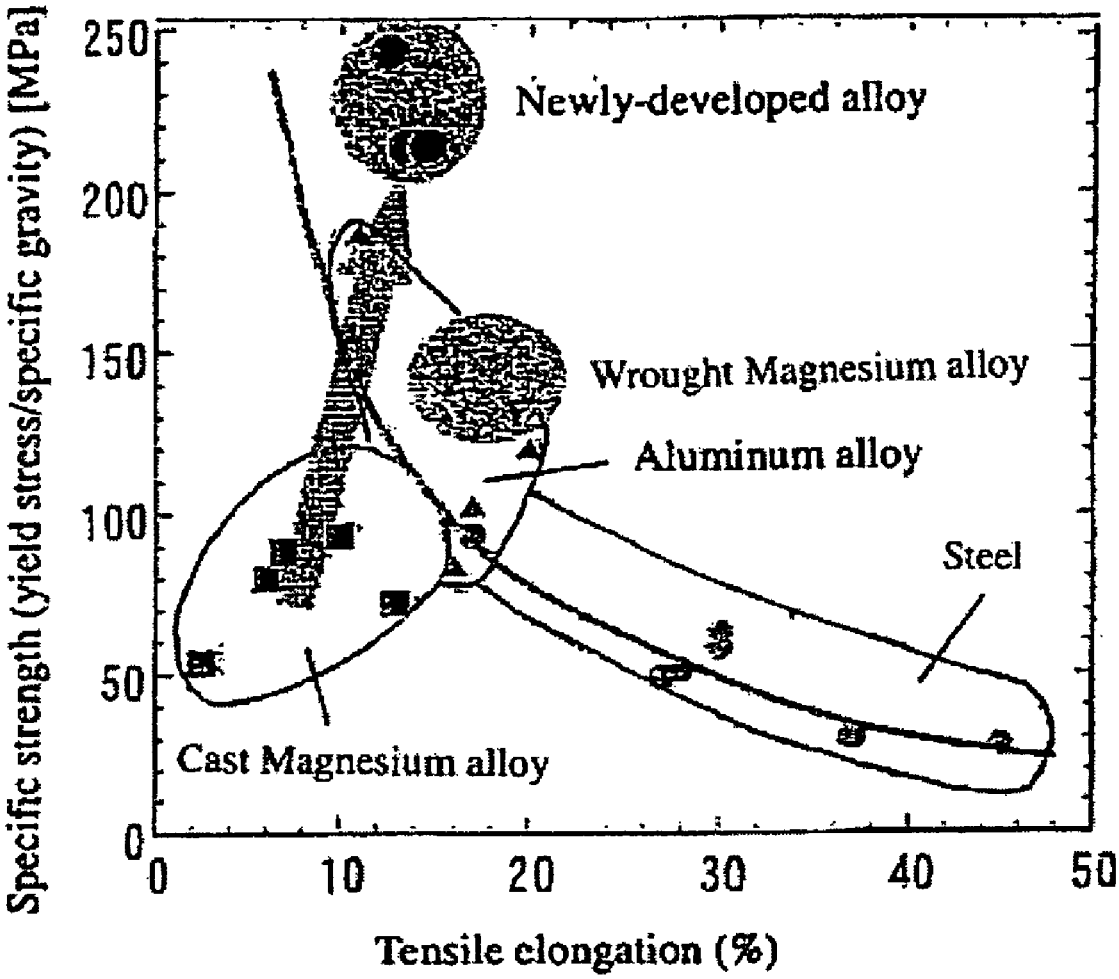
FIG. 2 is a drawing illustrating the balance between the specific strength (yield stress/specific gravity) and the tensile elongation of alloys in Examples, as compared with conventional magnesium cast material, magnesium wrought material, aluminum alloy and steel.

In FIG. 2, the balance between the specific strength (yield stress/specific gravity) and the tensile elongation of magnesium alloys according to the present invention, as compared with conventional magnesium cast alloy, magnesium wrought alloy, aluminum alloy and steel, is shown. In the figure, "newly-developed alloy" represents the magnesium alloy of the present invention. It is understood the figure that the magnesium alloy of the present invention is excellent in both strength and ductility.

Next, one example of a method for producing the magnesium alloy of the present invention will be described bellow. However, needless to say, it should be understood that the present invention is not limited to the method exemplified below.

First, the above-described solute atoms are melt-cast with magnesium to prepare a mother alloy. Then, the obtained mother alloy is subjected to homogenizing treatment, for example, in a furnace at a temperature of 450 to 550° C. for about 1.5 to 8 hours. After the homogenizing treatment, the product is taken out from the furnace and quenched by, for example, water quenching to freeze the uniformly dispersed structure. Then, a warm strain is applied at a temperature of 150 to 350° C. by, for example, warm extrusion to obtain an aimed magnesium alloy. When the temperature at which the warm strain is applied is within this range, it is possible to securely control the structure so that the solute atoms are disposed at a high concentration at portions in the vicinity of the crystal grain boundaries. Further, in a case where warm extrusion is employed, it is preferred that the extrusion ratio (by sectional area ratio) is 16:1 to 100:1. When the extrusion ratio is within this range, the warm strain will be properly applied.

Next, the present invention will be described with reference to Examples.

EXAMPLE 1

Figure 3:
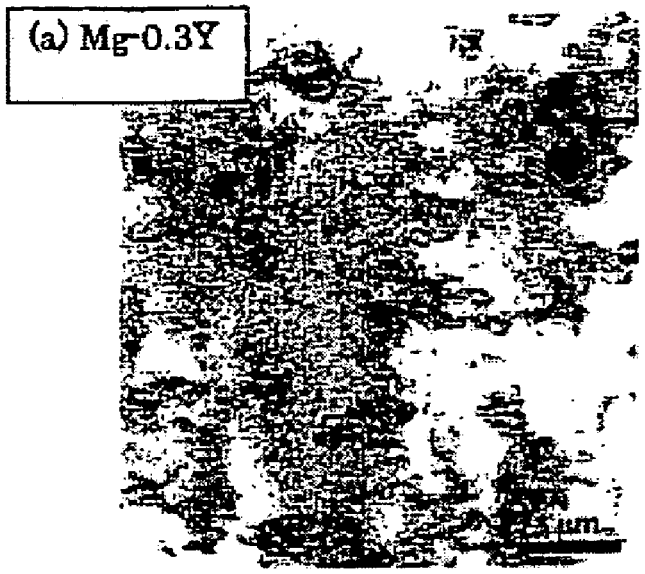
FIGS. 3(*a*) and 3(*b*) are images illustrating examples of the crystal structure of alloys in Examples, and FIG. 3(*a*) represents Mg-0.3Y and FIG. 3(*b*) represents Mg-0.3Ca.
Figure 3:
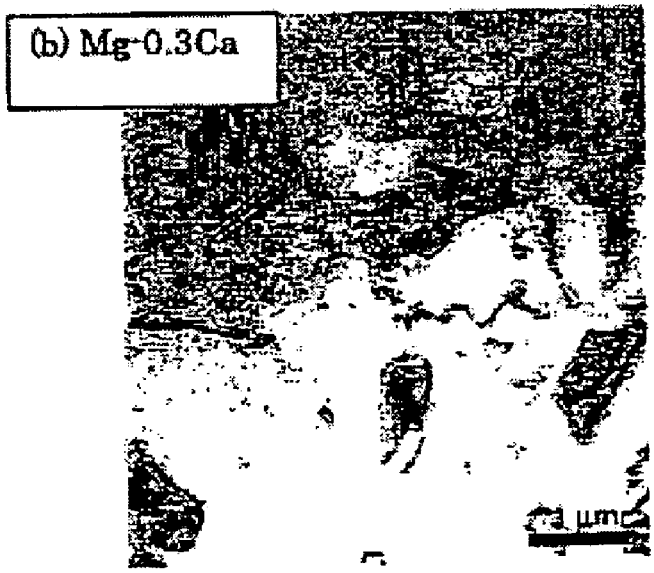
Figure 4:
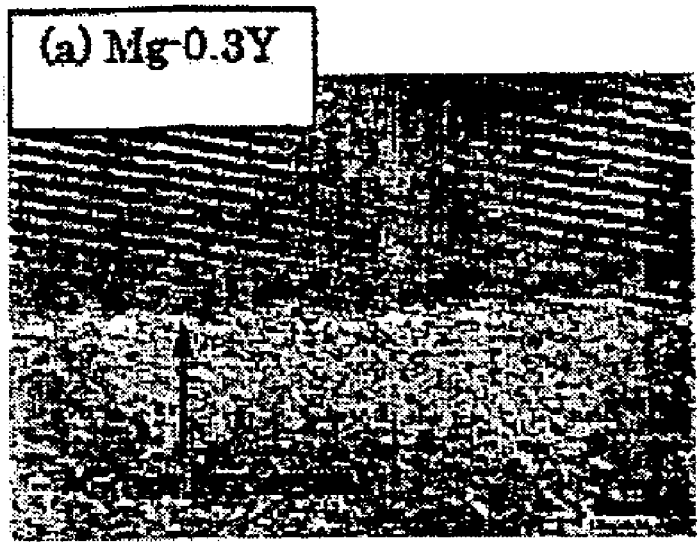
FIGS. 4(*a*) and 4(*b*) are images illustrating examples of the grain boundary structure of alloys in Examples and results of the atomic concentration measurement by means of nano-EDS, and FIG. 4(*a*) represents Mg-0.3Y and FIG. 4(*b*) represents Mg-0.3Ca.
Figure 4:
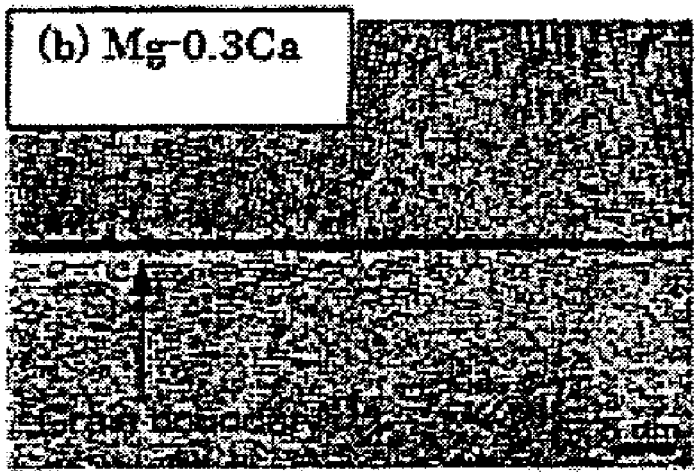

0.3 atomic % of yttrium was melt-cast with commercial pure magnesium (purity 99.94%) to obtain a mother alloy. Hereinafter the alloy having this composition will be referred to as Mg-0.3Y. The mother alloy was held in a furnace at 500° C. for 2 hours to carry out homogenizing treatment of yttrium atoms. After the alloy was taken out from the furnace, water quenching was carried out to freeze the uniformly solutionized structure. Then, an extrusion billet (diameter 40 mm, length 70 mm) was prepared by machining. The billet was heated to about 290° C., and then warm extrusion was carried out with an extrusion ratio of 25:1 to obtain an extruded material having a diameter of 8 mm. A test specimen for tensile test was machined from the extruded material, and the tensile properties were evaluated at a strain rate of $10^{-3}$ $s^{-1}$. As a result, high strength and high ductility with a yield stress of 380 MPa and a tensile elongation of 14% were confirmed (see FIG. 1(*a*)). As a result of observation of the structure, formation of a structure with an average crystal grain diameter of 1 μm or less was confirmed (see FIG. 3(*a*)). Further, the element concentration distribution was examined by means of high resolution observation and nano-EDS (energy-disperse X-ray spectroscopy) and as a result, the concentration was 0.30 atomic % in the crystal grains and 0.90 atomic % at portions in the vicinity of the crystal grain boundaries, whereby it was confirmed that yttrium was localized at portions in the vicinity of the crystal grain boundaries at a high concentration of about 3.0 times that in the crystal grains (see FIG. 4(*a*)).

Further, results of evaluation of the mechanical properties with respect to Mg-0.3Y having a structure with an average crystal grain diameter of 1 μm or less prepared in Example 1 and a Mg-0.3Y cast material (average crystal grain diameter of 100 μm or more) by means of a tensile test are shown in FIG. 1(*a*).

EXAMPLE 2

In the same manner as in Example 1 except that 0.3 atomic % of calcium was used instead of 0.3 atomic % of yttrium and that the material temperature before extrusion was about 250° C., preparation of a mother alloy, homogenizing treatment, water quenching, machining processing and warm extrusion were carried out. Hereinafter the alloy having this composition will be referred to as Mg-0.3Ca. A test specimen for tensile test was machined from the extruded material, and the tensile properties were evaluated at a strain rate of $10^{-3}$ $s^{-1}$. As a result, high strength and high ductility with a yield stress of 390 MPa and a tensile elongation of 12% were confirmed (see FIG. 1(*b*)). As a result of observation of the structure, formation of a structure with an average crystal grain diameter of 1 μm or less was confirmed (see FIG. 3(*b*)). Further, the element concentration distribution was examined by means of high resolution observation and nano-EDS and as a result, the concentration was 0.27 atomic % in the crystal grains and 0.74 atomic % at portions in the vicinity of the crystal grain boundaries, whereby it was confirmed that calcium was localized at portions in the vicinity of the crystal grain boundaries at a high concentration of about 2.7 times that in the crystal grains (see FIG. 4(*b*)).

Further, results of evaluation of the mechanical properties with respect to Mg-0.3Ca having a structure with an average crystal grain diameter of 1 μm or less prepared in Example 2, a Mg-0.3Ca cast material (average crystal grain diameter of 100 μm or more), pure magnesium (purity 99.94%) having a structure with an average crystal grain diameter of 1 μm or less, and a pure magnesium cast material having an average crystal grain diameter of 100 μm or more, by means of a tensile test are shown in FIG. 1(*b*).

As a result of comparison between the Mg-0.3Ca having a structure with an average crystal grain diameter of 1 μm or less prepared in Example 2 and pure magnesium (purity 99.94%) having a structure with an average crystal grain diameter of 1 μm or less, the effect brought about by the solute atoms is clear, and it is understood that high strength twice that without solute atoms is achieved. Further, as a result of comparison between the Mg-0.3Ca having a structure with an average crystal grain diameter of 1 μm or less prepared in Example 2 and the Mg-0.3Ca cast material having a structure with an average crystal grain diameter of 100 μm or more, it is understood that refinement of the crystal grains is also important for high strengthening.

EXAMPLE 3

In the same manner as in Example 2 except that 0.2 atomic % of calcium was used instead of 0.3 atomic % of calcium, preparation of a mother alloy, homogenizing treatment, water quenching, machining and warm extrusion were carried out.

With respect to the extruded material, the structure was observed and as a result, a structure with an average grain diameter of 1 μm or less was formed. Further, as a result of measurement by means of nano-EDS employing electron beams focused to 0.5 nm, the concentration was 0.18 atomic % in the crystal grains and 1.55 atomic % at portions in the vicinity of the crystal grain boundaries, whereby it was confirmed that calcium was localized at portions in the vicinity of the crystal grain boundaries at a concentration of about 8.6 times that in the crystal grains.

INDUSTRIAL APPLICABILITY

According to the present invention, the weight of an optional power-driven structure is drastically reduced by application of a high strength magnesium alloy, and at the same time, by imparting ductility to the material, structure-sustaining reliability and safety at the time of use are guaranteed. Therefore, the present invention is preferably applied to spacecraft, aircraft, trains, automobiles, wheelchairs, etc.

Further, according to the present invention, a magnesium alloy excellent in both high strength and high ductility can be realized, and by using a wrought alloy thereof, it is possible to make a large structure, and particularly when the wrought alloy is applied to a power-driven structure, excellent structure-sustaining reliability and safety can be expected.

Further, according to the present invention, since a fine crystal grain structure is formed, the following advantages can be obtained: excellent warm formability can be expected; the material cost can be suppressed since the volume fraction of the additive metal is very low; and the application of the wrought alloy will be broadened, and energy saving and reduction of the exhaust gas will be attained.

The invention claimed is:

1. A high strength and high ductility magnesium alloy comprising 0.03 to 0.54 atomic % of one type of solute atoms belonging to Group 2, Group 3 or Lanthanoid of the Periodic Table and having an atomic radius larger than that of magnesium, and the balanced amount of magnesium, and having a fine crystal grain structure wherein the average crystal grain diameter is 1.5 μm or less and the solute atoms are localized at portions in the vicinity of the crystal grain boundaries at a concentration of 1.5 to 10 times that of the solute atoms in the crystal grains.

2. The high strength and high ductility magnesium alloy according to claim 1, wherein the solute atoms are one type of atoms selected from the group consisting of Ca, Sr, Ba, Sc, Y, La, Ce, Pr, Nd, Pm, Sm, Eu, Gd, Dy, Tb, Ho, Er, Tm, Yb and Lu.

3. A method for producing a high strength and high ductility magnesium alloy comprising 0.03 to 0.54 atomic % of one type of solute atoms belonging to Group 2, Group 3 or Lanthanoid of the Periodic Table and having an atomic radius larger than that of magnesium, and the balanced amount of magnesium, the method comprising preparing a mother alloy comprising magnesium and solute atoms, subjecting the obtained mother alloy to homogenizing treatment at a temperature of 450 to 550° C. for 1.5 to 8 hours, followed by quenching, and further applying a warm strain at a temperature of 150 to 350° C. to form a fine crystal grain structure wherein the average crystal grain diameter is 1.5 μm or less and the solute atoms are localized at portions in the vicinity of the crystal grain boundaries at a concentration of 1.5 to 10 times that of the solute atoms in the crystal grains.

4. The method for producing a high strength and high ductility magnesium alloy according to claim 3, which uses, as the solute atoms, one type of atoms selected from the group consisting of Ca, Sr, Ba, Sc, Y, La, Ce, Pr, Nd, Pm, Sm, Eu, Gd, Dy, Tb, Ho, Er, Tm, Yb and Lu.

5. The method for producing a high strength and high ductility magnesium alloy according to claim 3, wherein the warm strain is applied by carrying out warm extrusion with an extrusion ratio (by sectional area ratio) of 16:1 to 100:1.

6. The method for producing a high strength and high ductility magnesium alloy according to claim 4, wherein the warm strain is applied by carrying out warm extrusion with an extrusion ratio (by sectional area ratio) of 16:1 to 100:1.

* * * * *